US012410570B2

(12) United States Patent
Hotchkin

(10) Patent No.: US 12,410,570 B2
(45) Date of Patent: Sep. 9, 2025

(54) BARRIER

(71) Applicant: SAFEROADS PTY LTD, Melbourne (AU)

(72) Inventor: Darren Hotchkin, Warragul (AU)

(73) Assignee: Saferoads Pty Ltd, Melbourne (AU)

( * ) Notice: Subject to any disclaimer, the term of this patent is extended or adjusted under 35 U.S.C. 154(b) by 0 days.

(21) Appl. No.: 18/443,480

(22) Filed: Feb. 16, 2024

(65) Prior Publication Data

US 2024/0191443 A1 Jun. 13, 2024

Related U.S. Application Data

(63) Continuation of application No. 16/960,933, filed as application No. PCT/AU2019/050009 on Jan. 10, 2019, now Pat. No. 11,933,004.

(30) Foreign Application Priority Data

Jan. 10, 2018 (AU) ..... 2018200202

(51) Int. Cl.
*E01F 15/08* (2006.01)
*E01F 13/02* (2006.01)

(52) U.S. Cl.
CPC ..... *E01F 15/083* (2013.01); *E01F 13/02* (2013.01); *E01F 15/085* (2013.01); *E01F 15/086* (2013.01); *E01F 15/088* (2013.01)

(58) Field of Classification Search
CPC ..... E01F 13/02; E01F 15/083; E01F 15/085; E01F 15/088
See application file for complete search history.

(56) References Cited

U.S. PATENT DOCUMENTS

| | | | | |
|---|---|---|---|---|
| 2,279,942 | A | 4/1942 | Hausherr | |
| 3,308,724 | A | 3/1967 | Henry | |
| 3,877,681 | A * | 4/1975 | Humphrey | E01F 15/006 256/64 |
| 3,934,540 | A | 1/1976 | Bruner et al. | |
| 3,952,690 | A | 4/1976 | Rizzo et al. | |
| 4,253,777 | A | 3/1981 | Pillifant, Jr. | |
| 4,348,133 | A | 9/1982 | Trent et al. | |
| 4,383,782 | A | 5/1983 | Pillifant, Jr. | |
| 4,496,264 | A | 1/1985 | Casey | |
| 4,502,812 | A | 3/1985 | Zucker | |
| 4,553,875 | A | 11/1985 | Casey | |

(Continued)

FOREIGN PATENT DOCUMENTS

| | | |
|---|---|---|
| DE | 102007029925 A1 | 1/2009 |
| DE | 102008052124 A1 | 4/2010 |

(Continued)

OTHER PUBLICATIONS

Examination Report dated Aug. 23, 2024 in related Australian Application No. 2019207522.

*Primary Examiner* — Gary S Hartmann
(74) *Attorney, Agent, or Firm* — DINSMORE & SHOHL LLP

(57) ABSTRACT

An elongate barrier (3) comprises an outer shell in an elongate lower section of the barrier that defines a cavity (11) that receives and contains a pourable settable ballast material when the barrier is being manufactured. The barrier also comprises a solid block (15) of a ballast material in the cavity formed from the pourable settable ballast material.

18 Claims, 5 Drawing Sheets

(56) References Cited

U.S. PATENT DOCUMENTS

| | | | | |
|---|---|---|---|---|
| 4,859,983 | A | 8/1989 | Kulp et al. | |
| 4,909,661 | A | 3/1990 | Ivey | |
| 5,052,850 | A | 10/1991 | Bishop | |
| 5,208,585 | A | 5/1993 | Sprague | |
| 5,746,538 | A | 5/1998 | Gunness | |
| 5,772,357 | A * | 6/1998 | Evans | E01F 9/588 256/13.1 |
| 6,782,624 | B2 | 8/2004 | Marsh et al. | |
| 7,168,882 | B1 * | 1/2007 | Owen | E01F 15/083 404/6 |
| 7,172,362 | B2 | 2/2007 | Schmitt | |
| 7,275,888 | B1 | 10/2007 | Christensen et al. | |
| 7,699,558 | B2 | 4/2010 | Adler et al. | |
| 8,061,925 | B2 * | 11/2011 | Volkmann | E01F 15/085 404/9 |
| 8,215,865 | B2 * | 7/2012 | Adler | E01F 13/12 |
| 8,226,321 | B2 | 7/2012 | Meyers | |
| 8,545,126 | B1 * | 10/2013 | Alsaffar | E01F 15/086 404/6 |
| 9,644,332 | B1 * | 5/2017 | Smith | E01F 15/083 |
| 10,246,843 | B1 | 4/2019 | Adams | |
| 10,689,814 | B2 | 6/2020 | Azizinamini | |
| 10,837,150 | B2 * | 11/2020 | Muegerl | E01F 15/088 |
| 11,105,055 | B1 | 8/2021 | Maguire | |
| 11,352,753 | B2 * | 6/2022 | Habodasz | E01F 15/02 |
| 11,933,004 | B2 * | 3/2024 | Hotchkin | E01F 15/086 |
| 2003/0081998 | A1 | 5/2003 | Yodock, III et al. | |
| 2004/0096273 | A1 | 5/2004 | Yodock, III et al. | |
| 2004/0197140 | A1 | 10/2004 | Maleska | |
| 2011/0280656 | A1 | 11/2011 | Meyers | |
| 2014/0270937 | A1 | 9/2014 | Kulkarni et al. | |
| 2016/0010294 | A1 | 1/2016 | Mcmaster | |
| 2016/0047095 | A1 | 2/2016 | Murphy | |
| 2016/0145819 | A1 | 5/2016 | Hotchkin et al. | |
| 2016/0208448 | A1 | 7/2016 | Nicosia et al. | |
| 2016/0369461 | A1 | 12/2016 | Mcmaster | |
| 2023/0068991 | A1 * | 3/2023 | Ramaekers | E01F 15/088 |

FOREIGN PATENT DOCUMENTS

| | | | |
|---|---|---|---|
| DE | 102012106933 | A1 | 1/2014 |
| DE | 202012104881 | U1 | 4/2014 |
| EP | 1162315 | A1 | 12/2001 |
| FR | 776756 | A | 2/1935 |
| FR | 2743825 | A1 | 7/1997 |
| GB | 2477296 | A | 8/2011 |
| JP | 02058606 | A | 2/1990 |
| JP | 02058607 | A | 2/1990 |
| JP | 2001207421 | A | 8/2001 |
| KR | 200357091 | Y1 | 7/2004 |
| WO | 2009000514 | A1 | 12/2008 |
| WO | 2009150428 | A1 | 12/2009 |
| WO | 2010133191 | A1 | 11/2010 |
| WO | 2011047659 | A1 | 4/2011 |

* cited by examiner

BARRIER

CROSS-REFERENCE TO RELATED APPLICATIONS

This application claims is a continuation application of U.S. application Ser. No. 16/960,933 filed Jul. 9, 2020, which is a national stage application, filed under 35 U.S.C. § 371, of International Patent Application No. PCT/AU2019/050009, filed on Jan. 10, 2019, which claims priority to Australia Application No. 2018/200202, filed Jan. 19, 2018, which are incorporated by reference herein in their entirety.

FIELD OF INVENTION

The present invention relates to a barrier that is suitable for use in dividing an area into separate areas.

More particularly, although by no means exclusively, the present invention relates to a barrier that is suitable for use in a large range of end-use applications that include, by way of example, use on roads for separating vehicles from other vehicles, separating vehicles from work zones so that work can be carried out safely in the work zones, and separating vehicles from pedestrians.

The present invention relates particularly, although by no means exclusively, to a stand-alone, self-supporting, lightweight and readily transportable metal (which term includes metal alloy) barrier.

The present invention also relates to a method of manufacturing the barrier.

BACKGROUND OF THE INVENTION

Known roadway barriers include:

(a) barriers made from concrete that rely on the weight of the concrete to function as barriers and typically weigh 700 kg/m of the length of the barrier;

(b) barriers that comprise shells made from plastics materials that are adapted to be filled with water and rely on the weight of the water to function as barriers and typically weigh at least 300 kg/m of the length of the barrier; and (c) barriers made from steel which also rely on the weight of the barriers to function as barriers and weigh at least 100 kg/m of the length of the barrier and, in many instances are fixed to the ground.

Whilst the above-described barriers function effectively as barriers, principally due to the substantial weights thereof, the substantial weights present significant transportation difficulties.

In addition, the need to fill water into and thereafter empty water from the plastics materials shell barriers presents significant handling issues and increases installation times considerably.

In addition, concrete barriers and water-filled barriers tend to crack when impacted by vehicles and lose functionality as a consequence and invariably cannot be used as barriers after a vehicle impact.

Moreover, the construction of these barriers, particularly concrete barriers and steel barriers, means that the barriers have no "give" on impact of a vehicle. A certain amount of resilience of a barrier on vehicle impact is helpful.

There is a need for a lightweight barrier that functions effectively as a barrier and can be readily be lifted into and from required roadway locations and is immediately functional as a barrier when lifted into position.

The above description of prior art barriers is not to be taken as an admission of the common general knowledge in Australia or elsewhere.

SUMMARY OF THE INVENTION

The present invention is based on a realization that an efficient and straightforward way to manufacture a barrier is to form a structure, such as an outer shell, in an elongate lower section of the barrier that defines a cavity that can receive and contain a pourable settable ballast material, pour the settable ballast material into the cavity, and allow the material to set and form a solid block of the ballast material in the cavity.

The present invention is also based on a realization that the resultant barrier, with a solid block of a ballast material contained within the structure, such as an outer shell, is an effective and cost-efficient barrier that can be readily transported from a manufacturing site to an end-use location and deployed immediately as a functional barrier.

In broad terms, the present invention provides a barrier that includes a structure that defines a cavity and is formed so that a settable ballast material can be poured into the cavity and contained by the structure, with the ballast material ultimately setting to form a solid block of ballast material.

The present invention provides an elongate barrier that comprises:

(a) an outer shell in an elongate lower section of the barrier that defines a cavity that receives and contains a pourable settable ballast material when the barrier is being manufactured; and (b) a solid block of the ballast material in the cavity formed from the pourable settable ballast material.

The outer shell may comprise a base wall, opposed side walls and opposed end walls that define the cavity.

The barrier may comprise a single cavity that extends at least substantially the length of the barrier.

The barrier may comprise a plurality of cavities spaced apart along the length of the barrier. With this arrangement, the barrier comprises at least two solid blocks of the ballast material in the cavities along the length of the barrier.

The barrier may comprise a plurality of cavities spaced apart across the width of the barrier. With this arrangement, the barrier comprises at least two solid blocks of the ballast material in the cavities across the width of the barrier.

The barrier may comprise at least one opening to allow the settable ballast material to be poured into the cavity during manufacture of the barrier.

One or both end walls may be formed with openings to allow the pourable settable ballast material to be poured into the cavity during manufacture of the barrier.

It is not essential that the outer shell of the barrier provide the barrier with substantial structural rigidity. This makes it possible to minimize the weight of the outer shell.

In this context, the principal purpose of the side walls of the outer shell of the barrier is to deflect a vehicle on impact of the vehicle against the barrier. Accordingly, it is not essential that the side walls make a substantial contribution to the rigidity of the barrier. Typically, the outer shell contributes no more than 30%, typically no more than 20%, of the rigidity of the barrier.

The outer shell of the barrier may be formed from steel strip or plate (hereinafter referred to as "strip/plate").

The outer shell of the barrier may be formed by folding one or more than one sheets of steel strip/plate.

The base wall and opposed side walls of the outer shell of the barrier may be formed by folding a sheet of steel strip/plate along the length of the sheet.

The base wall and the side walls of the outer shell of the barrier may comprise two components that are connected together. Each component may be formed by folding, for example by roll-forming, two sheets of steel strip/plate along the length of each sheet to form one side wall and one-half section of the base wall. The two components are connected together, such as by welding, along the side edges of the base half sections of the components. With this arrangement, the end walls of the outer shell of the barrier are formed as separate components and are connected, such as by welding, to the base wall and side walls of the outer shell.

The side walls may converge inwardly from the base wall when viewed from the ends of the barrier. For example, the side walls and the base may define a generally triangular shape when viewed from the ends of the barrier.

The side walls may be a profile that facilitates deflecting vehicles on impact.

For example, the side walls may be straight side walls.

Alternatively, the side walls may include lengthwise extending corrugations that define ribs.

The barrier may comprise an upper elongate structural element extending along the length of the barrier.

The principal purpose of the upper structural element is to provide the barrier with sufficient rigidity along the length of the barrier to meet the design requirements of the barrier. By way of particular example, the upper structural element provides longitudinal strength that restrains and contains and re-directs a vehicle while resisting substantial bending of the element.

The upper structural element may be connected to the outer shell by any suitable means. By way of example, in situations in which the upper structural element and the outer shell are made from steel, typically the two components are welded together.

The upper structural element may be any suitable element that contributes to the rigidity of the barrier.

The upper structural element may be an upper rail.

The upper rail may be a solid beam or a hollow beam.

The upper rail may be a hollow box beam section.

The box beam section may have a constant transverse cross-section along the length of the box beam section.

The box beam section may be any suitable transverse cross-section.

The box beam section may have a square transverse cross-section.

The box beam section may be formed by folding, for example by roll-forming, a sheet of steel strip/plate along the length of the sheet to form the box beam section with a required transverse cross-section.

The principal purpose of the block of the ballast material provides weight to resist shunting action on vehicle impact that would move the barrier significantly from a preferred position on the ground.

The ballast material may be any suitable material.

By way of example, the ballast material may be concrete.

The concrete may have at least a medium compressive strength.

Typically, the compressive strength of the concrete is at least 20, typically at least 25, MPa.

The ballast material may be a pourable, self-leveling, settable material such as a pourable, self-leveling, settable concrete that, in the manufacture of the barrier, is poured into the cavity and allowed to set.

The height of the ballast block may be lower than the height of a typical vehicle impact with the barrier.

The ballast block height may be less than 50% of the total height of the barrier.

The ballast block height may be less than 45% of the total height of the barrier.

The ballast block height may be less than 40% of the total height of the barrier.

The ballast block height may be at least 20% of the total height of the barrier.

The ballast block height may be at least 25% of the total height of the barrier.

The weight of the ballast block may be up to 85% of the total weight of the barrier.

The weight of the ballast block may be up to 80% of the total weight of the barrier.

The weight of the ballast block may be up to 70% of the total weight of the barrier.

The weight of the ballast block may be up to 60% of the total weight of the barrier.

The weight of the ballast block may be at least 45% of the total weight of the barrier.

The weight of the barrier may be less than 450 kg/m of length of the barrier.

The weight of the barrier may be less than 400 kg/m of length of the barrier.

The weight of the barrier may be less than 350 kg/m of length of the barrier.

The weight of the barrier may be more than 250 kg/m of length of the barrier.

The barrier may comprise complementary connectors at the ends of the barrier to allow a plurality of the barrier to be connected together in end-to-end relationship.

The connectors may be any suitable connectors mounted to the ends of the upper structural element of the barrier.

By way of example, the connectors may be the connectors described in Australian patent application 2015203840 in the name of the applicant. The disclosure in Australian patent application 2015203840 is incorporated herein by cross-reference.

The barrier may comprise one or more than one lifting point for the barrier.

The lifting point or points may be any suitable lifting point or points formed in or mounted to the upper structural element of the barrier.

The lifting point or points may be one or more than one suitable opening in the upper structural element that can receive a crane hook to facilitate lifting of the barrier.

The barrier may comprise feet that, in use, contact a ground surface.

The combination of the upper structural element and the ballast of the above-described barrier provide the barrier with sufficient rigidity for resisting collapse of the barrier in response to vehicle impact. In effect, the ballast located within the lower section of the barrier defines a lower structural element. Specifically, the combination defines two spaced-apart structural elements that cooperate to provide the barrier with sufficient rigidity for resisting direct collapse of the barrier in the regions of vehicle impact.

Typically, the combination provides at least 80%, more typically at least 90%, of the rigidity for resisting collapse of the barrier in response to vehicle impact.

The barrier may be any suitable length.

Typically, the barrier is at least 3 m, typically at least 4 m, more typically at least 5 m, long.

The barrier may be any suitable height.

Typically, the barrier is at least 60 cm, typically at least 70 cm, more typically at least 80 cm, high.

Typically, the barrier is less than 1 m high.

The present invention also provides an elongate barrier that comprises:

(a) an outer shell that includes a base wall, opposed side walls and opposed end walls that define a cavity; and (b) a solid block of a ballast material in the cavity formed from a settable ballast material that is poured into the cavity and allowed to set into the solid block during manufacture of the barrier.

The present invention also provides a barrier assembly comprising a plurality of the above-described barrier connected together in end-to-end relationship in a line of the barriers.

The present invention also provides a method of manufacturing an elongate barrier that comprises:

(a) forming the outer shell of the above-described barrier, (b) pouring a pourable, settable ballast material into the cavity and allowing the ballast material to set and form a solid block of the ballast material in the cavity.

Step (a) of the method may comprise forming the upper structural element of the above-described barrier and connecting the element to the outer shell, for example by welding the components together in a situation where the components are made from steel.

The method may comprise forming the upper structural element by folding, such as by roll-forming, a sheet of steel strip/plate along the length of the sheet to form a box beam section with a required transverse cross-section.

Step (a) of the method may comprise forming the base wall and the side walls of the outer shell from two separate mirror-image components, with each component comprising one half of the base wall and one of the side walls, and connecting the components together, forming the end walls of the outer shell as separate components, and connecting the end walls to opposite ends of the base wall and side walls to form the outer shell.

The method may comprise forming each of the two components of the base wall and side walls by folding, such as by roll-forming, a sheet of steel strip/plate along the length of the sheet to form one half of the base wall and one of the side walls.

DESCRIPTION OF THE FIGURES

The present invention is described further by way of example only with reference to the accompanying drawings, of which.

DETAILED DESCRIPTION

Figure 1:
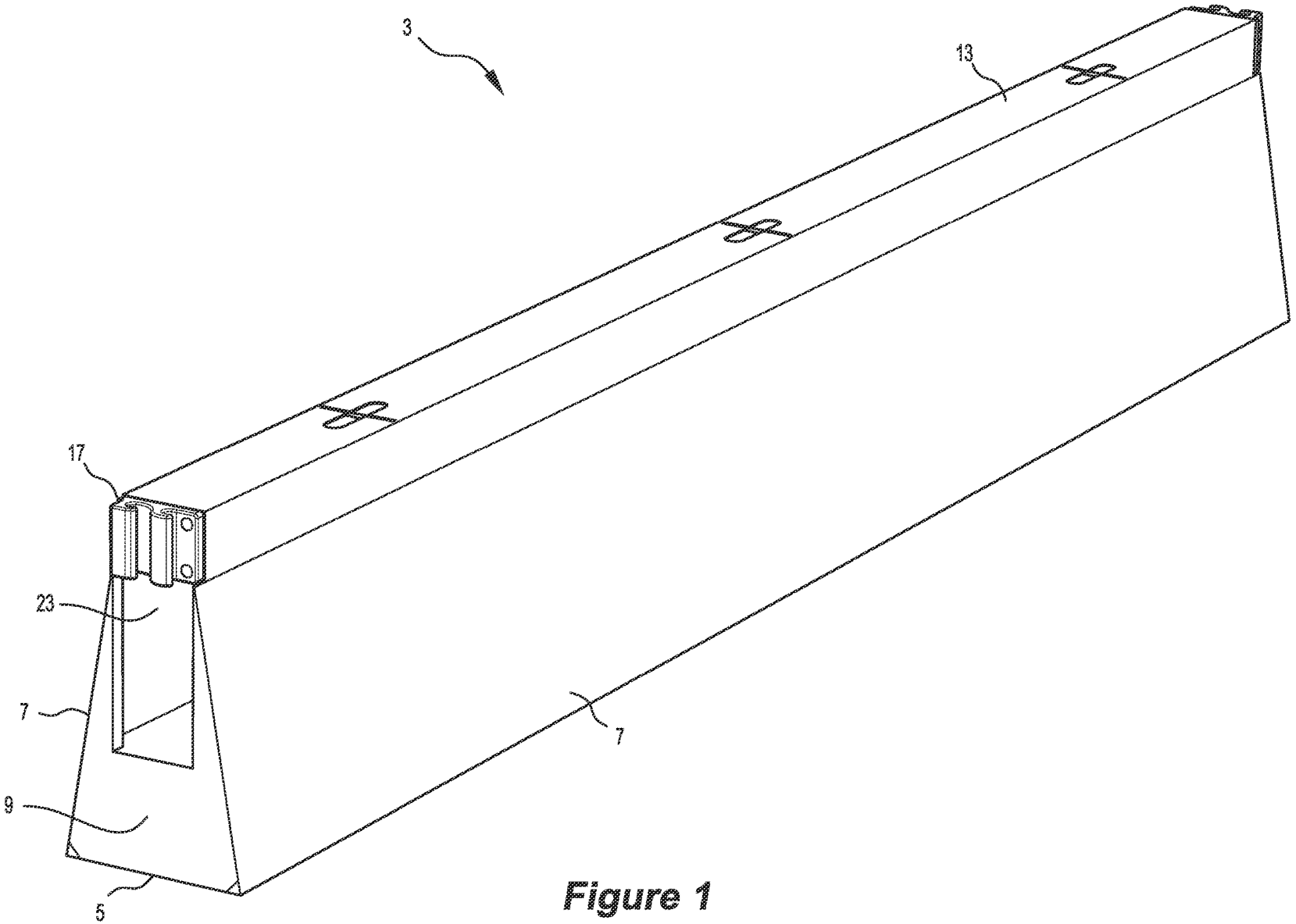
FIG. 1 is a perspective view of one embodiment of an elongate barrier in accordance with the present invention.
Figure 2:
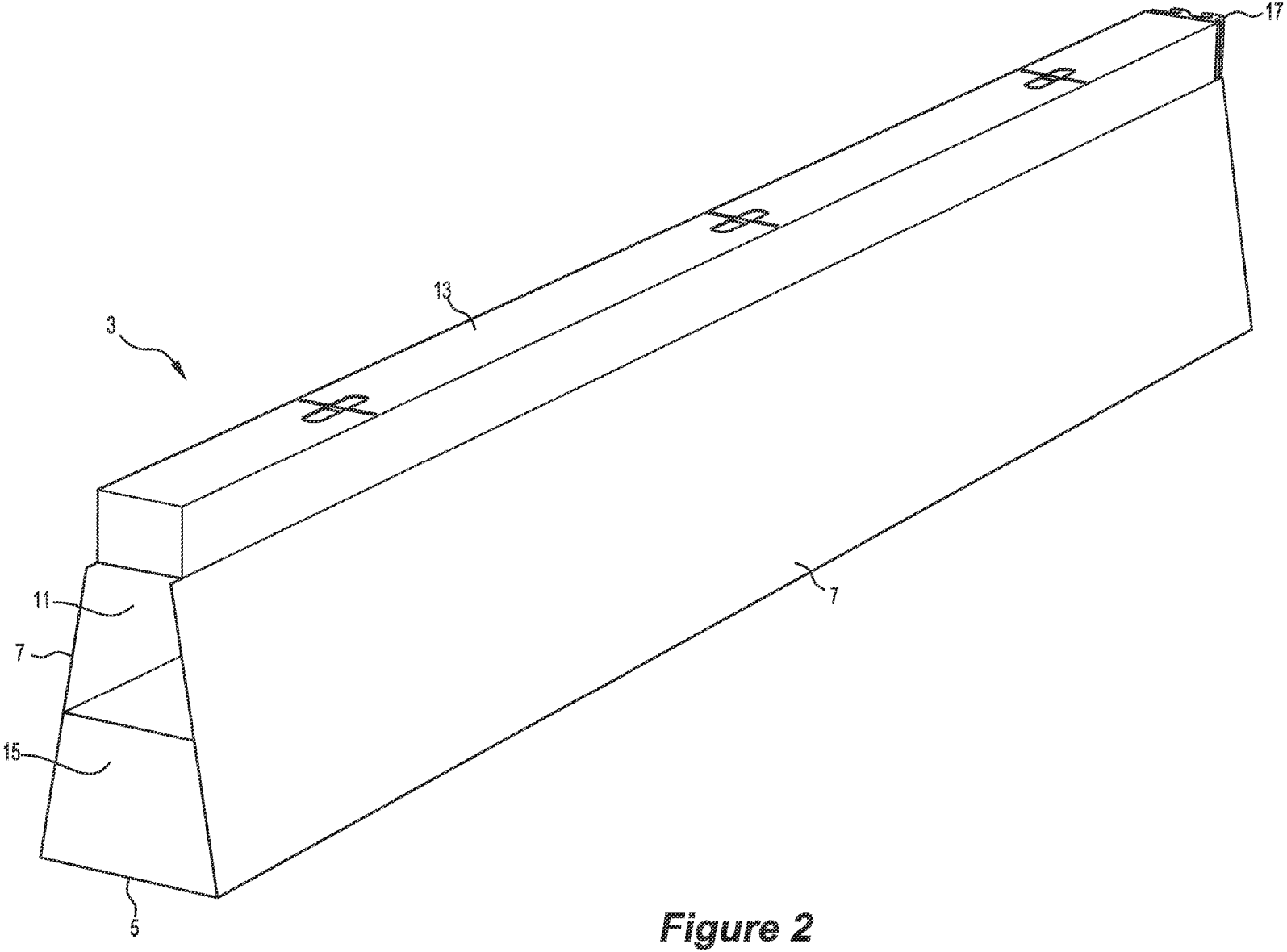
FIG. 2 is a perspective view of the barrier shown in FIG. 1 with the end wall removed to show the block of ballast material in the cavity of the barrier.
Figure 3:
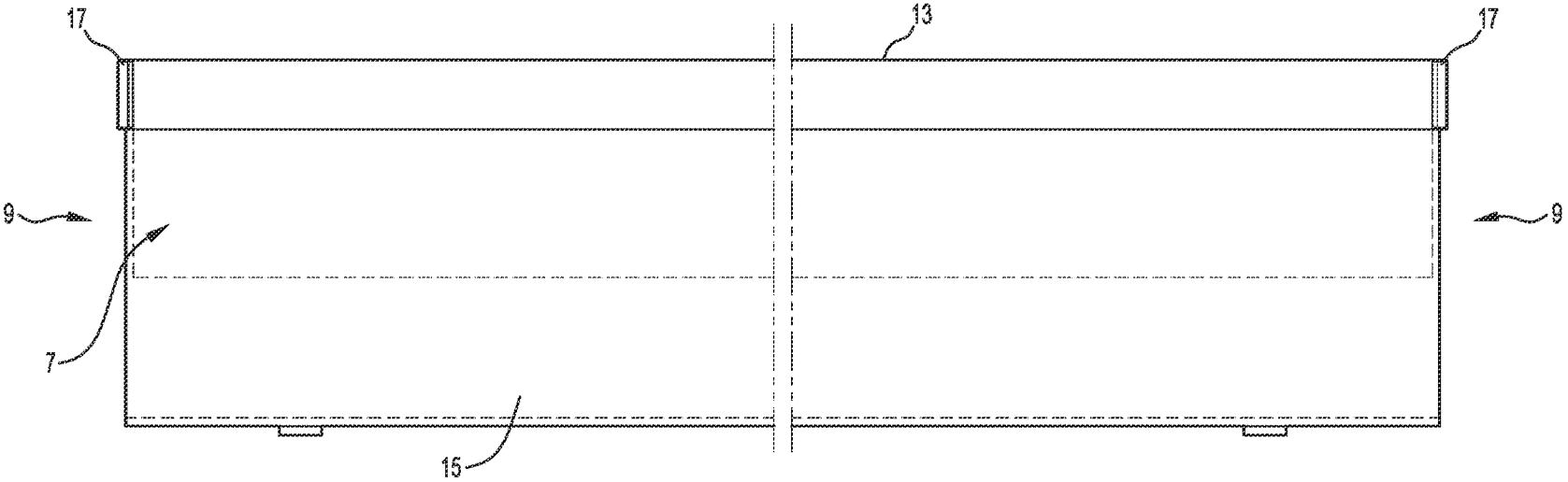
FIG. 3 is a side view of the barrier shown in FIG. 1.
Figure 6:
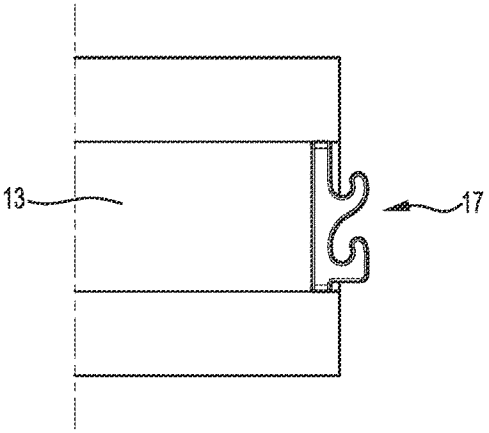
FIG. 6 is an enlargement of the circled region A in FIG. 5.
Figure 4:
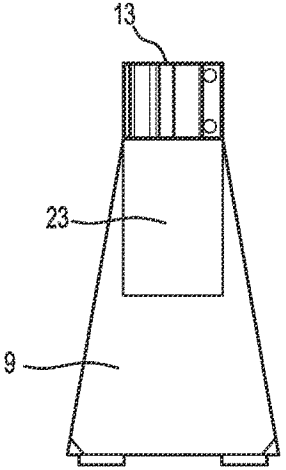
FIG. 4 is an end view of the barrier shown in FIG. 1.
Figure 5:
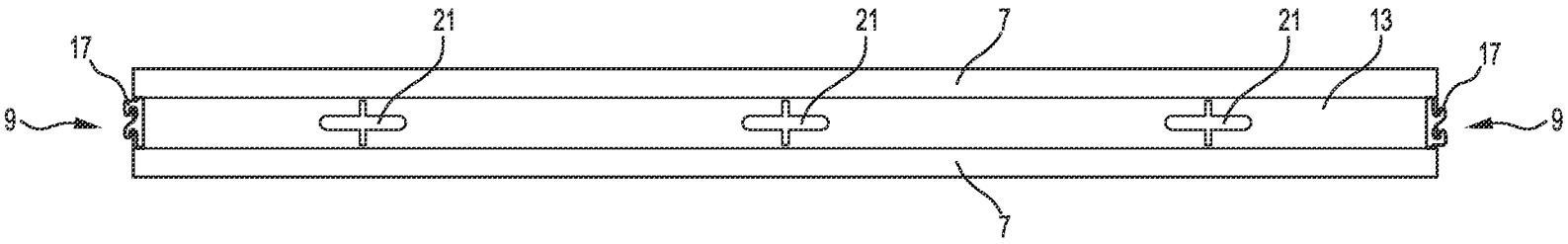
FIG. 5 is a top view of the barrier shown in FIG. 1.

The embodiment of the elongate barrier 3 shown in the Figures is typically 5.8 m long, 900 mm high, 450 mm wide at the base and 200 mm wide at the top and weighs less than 2.6 tonnes and comprises:

(a) an outer shell in an elongate lower section of the barrier 3 that defines a cavity 11 (see FIG. 2) that receive and contain a pourable, self-leveling, settable ballast material when the barrier 3 is being manufactured;

(b) an upper structural element 13 extending along the length of the barrier, (c) a solid block 15 of a ballast material in the cavity 11 formed from the pourable settable ballast material which partially fills the cavity 11—see FIGS. 2 and 3; and (d) complementary connectors 17, such as described in Australian patent application 2015203840 in the name of the applicant, at the ends of the barrier 3 that allow a plurality of the barriers 3 to be connected together in end-to-end relationship.

The outer shell comprises a base wall 5, opposed side walls 7, and opposed end walls 9.

The side walls 7 are straight walls that converge towards each other from the base wall 5.

The end walls 9 of the outer shell are formed with openings 23 to allow self-leveling, settable ballast material to be poured into the cavity 11 during manufacture of the barrier 3.

The purpose of the upper structural element 13 of the barrier 3 is to provide the barrier 3 with sufficient rigidity along the length of the barrier 3 to meet the design requirements of the barrier 3.

By way of particular example, the upper structural element 13 provides longitudinal strength that restrains and contains and re-directs a vehicle while resisting substantial bending of the element 13. This was evident from the crash test results reported below. In particular, the crash tests showed that there was substantially no bending of the structural element 13 along the length of the barrier 3.

The upper structural element 13 of the barrier 3 is in the form of a hollow box beam section 13 having a constant square transverse cross-section along the length of the box beam section 13.

The box beam section 13 is formed by roll-forming a sheet of steel strip/plate along the length of the sheet to form the box beam section with the square cross-section.

The box beam section 13 has several lifting points 21 cut into an upper wall at spaced intervals along the length of the barrier 3. The lifting points 21 are formed to receive a crane hook (not shown) to facilitate lifting of the barrier 3.

The box beam section 13 and the outer shell are welded together.

The solid block 15 of the ballast material is in a lower section of the barrier 3.

The maximum height of the ballast block 15 is selected to be lower than the height of a typical vehicle impact with the barrier 3. Typically, this means that the height of the ballast block 15 is up to 40 cm high. This height selection ensures that the ballast block 15 resists shunting movement of the barrier 3.

Typically, the total weight of the barrier 3 is 50% or more less weight than a standard Jersey barrier of the same length and height.

In use, the barrier 3 can be conveniently transported from a storage location to an end-use location, such as a roadside, and then lifted by a crane into position as an immediately functional barrier.

Typically, the barrier 3 is used in a line of the barriers 3, with preceding and successive barriers 3 connected together via the connectors 17.

The above-described arrangement and selection of the components of the upper structural element 13 of the barrier 3 and the ballast block 15 of the barrier 3 provides an effective response to vehicle impact. In particular, when a plurality of the barriers 3 are connected together in a line via the connectors 17, there will be substantially no bending of an individual barrier 3 in response to vehicle impact, and vehicle impact energy is absorbed by deflection of the line of barriers 3 from an initial position of the line.

As is clear from the crash test results discussed below, the line of barrier rather than one barrier responds to vehicle impact.

Typically, in use, the barrier 3 is used as a free-standing barrier. However, it is noted that the invention extends to barriers 3 that, in use, are pinned or otherwise secured to the ground.

The embodiment of the barrier 3 shown in the Figures is manufactured by the following steps:

(a) forming the outer shell of the barrier 3, (b) forming the upper structural element 13 of the barrier 3, (c) connecting together, the upper structural element 13 and the outer shell, for example by welding the components together, and (d) pouring a self-leveling, settable ballast material, such as a pourable self-leveling settable concrete having a compressive strength of at least 20 MPa, into the cavity 11 in the outer shell via the openings 23 in the end walls 5, until the ballast material reaches a required height; and (e) allowing the ballast material to set and form a block 15 of the ballast material in the cavity 11.

It is noted that a key requirement of the outer shell of the barrier 3 is to contain settable ballast material that is poured into the cavity defined by the outer shell until such time that the ballast material sets into a solid block.

Figure 7:
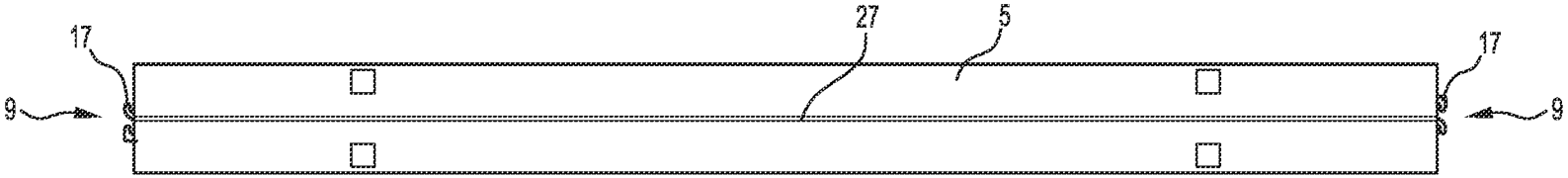
FIG. 7 is a bottom view of the barrier shown in FIG. 1.
Figure 9:
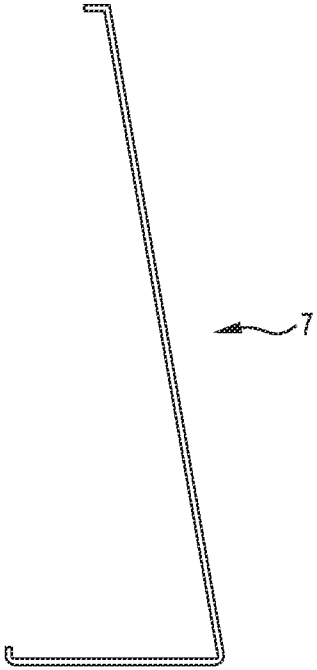
FIG. 9 is an end view of an enlargement of one of two components that form the base wall and side walls of the lower section of the barrier shown in FIG. 1.
Figure 8:
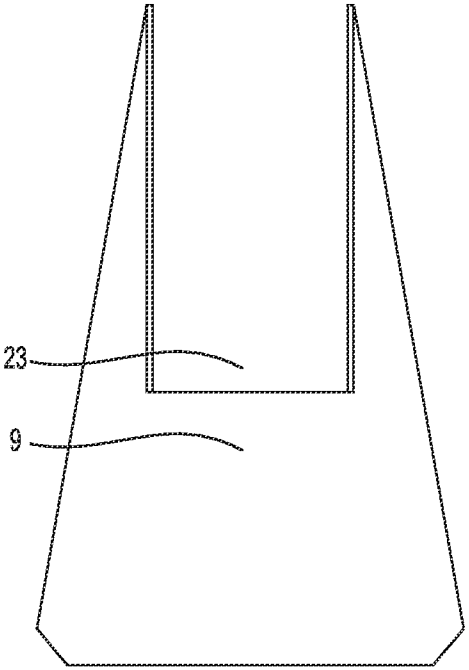
FIG. 8 is an enlargement of one end wall of the lower section of the barrier shown in FIG. 1.

The base wall 5 and the side walls 7 of the outer shell are formed from two separate mirror-image components. Each component is formed by roll-forming or pressing or otherwise folding a sheet of steel strip/plate along the length of the sheet. Typically, the strip/plate is 3-4 mm thick and the steel is grade 350 steel. Each component comprises one half of the base wall 5 and one of the side walls 7. The two components are connected together, for example by welding, along the side edges of the base halves, thereby forming a central seam 27 in the base wall 5—see FIG. 7.

The end walls 9 of the outer shell are also formed as separate components, with each end wall having an opening 23 in an upper section of the end wall 9. The end walls 9 are connected, for example by welding, to opposite ends of the base wall 5 to complete the construction of the outer shell.

The openings 23 in the end walls 9 of the outer shell may be any suitable shape and dimensions through which settable ballast material can be poured into the cavity during the manufacture of the barrier 3.

The upper structural element 13 is formed by roll-forming a sheet of steel strip/plate along the length of the sheet to form a box beam section with the required square transverse cross-section.

Typically, step (d) above includes using a pencil vibrator after the settable ballast material reaches a predetermined minimum level to ensure that the settable ballast material is distributed properly within the cavity 11.

The performance of the barrier 3 shown in the Figures has been assessed in a vehicle crash test carried out by Crashlab (Registered Trade Mark), a commercial business unit of Roads and Maritime Services, a NSW Government agency and corporation incorporated under section 46 of the Transport Administration Act 1988 (NSW).

Crashlab is a NATA accredited laboratory in the field of Mechanical Testing.

The crash test was the tougher of the two tests needed to pass Test Level 3 (TL-3) MASH ("Manual for Assessing Safety Hardware" of the American Association of State Highway and Transportation Officials (ASSHTO)) crash performance standards that are mandatory for contracts for Temporary Road Safety Barrier Systems on the US national highway system with a letting date after 31 Dec. 2019.

The test was a 100 kph test for a 2,270 kg vehicle, impacting at a 25° angle.

The deflection result was less than 1 meter, which is extremely low for a free-standing temporary barrier, particularly given the weight of this new barrier is half the weight of conventional concrete temporary barriers most commonly used.

The occupant risk values were well within the specification.

The deflection, Occupant Impact Velocity ("OIV") and Ride Down G-forces were all below MASH test results for a conventional F-type concrete barrier.

The test results are presented in the following Table 1.

TABLE 1

| | MASH standard - desirable results | MASH standard - minimum results | F-type concrete | Invention |
|---|---|---|---|---|
| Occupant Impact Velocity (m/s) | 9.1 | 12.2 | 6.8 | 6 |
| Ride Down G-Forces (g's) | 15 | 20.49 | 15.9 | 13.3 |
| Dynamic Deflection (m) | | | 1.27 | 0.9 |
| Barrier Weight (kg/m) | | | 711 | 357 |
| Barrier Width (m) | | | 0.6 | 0.45 |
| Working Width (m) | | | 1.87 | 1.35 |

The above-described crash test results indicate that the barrier complies with the MASH test requirements.

In addition to the above crash tests, the performance of the barrier 3 shown in the Figures has been assessed in a series of full scale vehicle crash tests carried out at the Texas A&M Transportation Institute Proving Ground in Bryan Texas, US.

The purpose of the full-scale crash tests was to assess the performance of the barrier 3 according to MASH Test Level 4 (TL-4) of the safety-performance evaluation guidelines of the Manual for Assessing Safety Hardware (MASH).

MASH Test Level 4 (TL-4) tests involve three tests, namely:

(a) an 1100C vehicle weighing 1100 kg+/−25 kg impacting a line of barriers 3 at a target impact speed of 100 km/h and an impact angle of 25° (Test 4-10), (b) a 2270P vehicle weighing 2270 kg+/−50 kg impacting a line of barriers 3 at a target impact speed of 100 km/h and an impact angle of 25° (Test 4-11), and (c) a 10000S vehicle weighing 10000 kg+/−300 kg impacting a line of barriers 3 at a target impact speed of 90 km/h and an impact angle of 15°.

The report advises that the barrier 3 performed acceptably according to MASH Test Level 4 (TL-4) criteria for longitudinal barriers.

The barrier 3 used in the crash tests was 5.8 m long, 900 mm high, 450 mm wide at the base and 200 mm wide at the top. The slope of the side walls 7 was 10.125° inwardly from the vertical. The vertical height of the side walls 7 was 700 mm. The box beam section 13 of the barrier 3 was 200 mm high by 200 mm wide. The solid block 15 of concrete ballast material filled the cavity to a height of 30 cm. The total weight of the barrier 3 was approximately 2.1 tonnes.

Each test was carried out with 48 of the barriers 3 connected together in a line via the complementary connectors 17 as described in Australian patent application 2015203840 in the name of the applicant. The total line length was 278.4 m.

The test results are summarized below as follows:

High containment of vehicles by the line of barriers 3.

Low barrier deflection—the line of barriers 3 presented a substantial total mass, and the line absorbed impact energy via deflection of the line—i.e. energy absorption by moving barriers 3 from initial positions in the line with overall low deflection of the line.

Low barrier damage—the barriers 3 retained structural integrity.

Safe and predictable vehicle re-direction.

Fast deployment and retrieval of the barriers 3 was possible.

No anchoring of barriers 3 required.

The test results are presented in the following Tables 2-4, noting that the barrier 3 is described as the "HV2" barrier in the Tables.

TABLE 2

Performance Evaluation Summary for MASH Test 4-10 on HV2 Barrier. Test Agency: Texas A&M Transportation Institute

| | MASH Test 4-10 Evaluation Criteria | Test Results | Assessment |
|---|---|---|---|
| | Structural Adequacy | | |
| A. | Test article should contain and redirect the vehicle or bring the vehicle to a controlled stop; the vehicle should not penetrate, underride, or override the installation although controlled lateral deflection of the test article is acceptable. | The HV2 Barrier contained and redirected the 1100C vehicle. The vehicle did not penetrate, underride, or override the installation. Maximum dynamic deflection during the test was 0.75 m (2.45 ft). | Pass |

TABLE 2-continued

Performance Evaluation Summary for MASH Test 4-10 on HV2 Barrier. Test Agency: Texas A&M Transportation Institute

| | MASH Test 4-10 Evaluation Criteria | Test Results | Assessment |
|---|---|---|---|
| | Occupant Risk | | |
| D. | Detached elements, fragments, or other debris from the test article should not penetrate or show potential for penetrating the occupant compartment, or present an undue hazard to other traffic, pedestrians, or personnel in a work zone. | No detached elements, fragments, or other debris were present to penetrate or show potential for penetrating the occupant compartment, or to present undue hazard to others in the area. | Pass |
| | Deformations of, or intrusions into, the occupant compartment should not exceed limits set forth in Section 5.2.2 and Appendix E of MASH. | Maximum occupant compartment deformation was 102 mm (4.0 inches). | |
| F. | The vehicle should remain upright during and after collision. The maximum roll and pitch angles are not to exceed 75 degrees. | The 1100C vehicle remained upright during and after the collision event. Maximum roll and pitch angles were 15° and 4°, respectively. | Pass |
| H. | Occupant impact velocities (OIV) should satisfy the following limits: Preferred value of 30 ft/s , or maximum allowable value of 40 ft/s. | Longitudinal OIV was 5.2 m/s (17 .1 ft/s), and lateral OIV was 6.2 m/s (20.3 ft/s). | Pass |
| I. | The occupant ride down accelerations should satisfy the following limits: Preferred value of 15.0 g, or maximum allowable value of 20.49 g, | Maximum 10-ms longitudinal occupant ride down acceleration was 4.8 g, and maximum 10-ms occupant lateral ride down was 7.9 g. | Pass |

TABLE 3

Performance Evaluation Summary for MASH Test 4-11 on HV2 Barrier. Test Agency: Texas A&M Transportation Institute

| | MASH Test 4-11 Evaluation Criteria | Test Results | Assessment |
|---|---|---|---|
| | Structural Adequacy | | |
| A. | Test article should contain and redirect the vehicle or bring the vehicle to a controlled stop; the vehicle should not penetrate, underride, or override the installation although controlled, lateral deflection of the test article is acceptable. | The HV2 Barrier contained and redirected the 2270P vehicle. The vehicle did not penetrate, underride, or override the installation. Maximum dynamic deflection during the test was 1.47 m (4.83 ft). | Pass |

TABLE 3-continued

Performance Evaluation Summary for MASH Test 4-11 on HV2 Barrier. Test Agency: Texas A&M Transportation Institute

| | MASH Test 4-11 Evaluation Criteria | Test Results | Assessment |
|---|---|---|---|
| | Occupant Risk | | |
| D. | Detached elements, fragments, or other debris from the test article should not penetrate or show potential for penetrating the occupant compartment, or present an undue hazard to other traffic, pedestrians, or personnel in a work zone. | No detached elements, fragments, or other debris were present to penetrate or show potential for penetrating the occupant compartment, or to present undue hazard to others in the area. | Pass |
| | Deformations of, or intrusions into, the occupant compartment should not exceed limits set forth in Section 5.2.2 and Appendix E of MASH. | Maximum occupant compartment deformation was 140 mm (5.5 inches) in the left front firewall area. | |
| F. | The vehicle should remain upright during and after collision. The maximum roll and pitch angles are not to exceed 75 degrees. | The 2270P vehicle remained upright during and after the collision event. Maximum roll and pitch angles were 14° and 6°, respectively. | Pass |
| H. | Occupant impact velocities (OIV) should satisfy the following limits: Preferred value of 30 ft/s, or maximum allowable value of 40 ft/s. | Longitudinal OIV was 4.1 m/s (13.4 ft/s) , and lateral OIV was 4.8 m/s (15.8 ft/s). | Pass |
| I. | The occupant ride down accelerations should satisfy the following limits: Preferred value of 15.0 g, or maximum allowable value of 20.49 g, | Maximum 10 -ms longitudinal occupant ride down acceleration was 5.0 g, and maximum 1 0-ms occupant lateral ride down was 10.3 g. | Pass |

TABLE 4

Performance Evaluation Summary for MASH Test 4-12 on HV2 Barrier. Test Agency: Texas A&M Transportation Institute

| | MASH Test 4-12 Evaluation Criteria | Test Results | Assessment |
|---|---|---|---|
| | Structural Adequacy | | |
| A. | Test article should contain and redirect the vehicle or bring the vehicle to a controlled stop; the vehicle should not penetrate, underride, or override the installation although controlled lateral deflection of the test article is acceptable. | The HV2 Barrier contained and redirected the 10000S vehicle. The vehicle did not penetrate, underride, or override the installation. Maximum dynamic deflection during the test was 2.37 m (7.77 ft). | Pass |

TABLE 4-continued

Performance Evaluation Summary for MASH Test 4-12 on HV2 Barrier. Test Agency: Texas A&M Transportation Institute

| | MASH Test 4-12 Evaluation Criteria | Test Results | Assessment |
|---|---|---|---|
| | Occupant Risk | | |
| D. | Detached elements, fragments, or other debris from the test article should not penetrate or show potential for penetrating the occupant compartment, or present an undue hazard to other traffic, pedestrians, or personnel in a work zone. | No detached elements, fragments, or other debris were present to penetrate or show potential for penetrating the occupant compartment, or to present undue hazard to others in the area. | Pass |
| | Deformations of, or intrusions into, the occupant compartment should not exceed limits set forth in Section 5.2.2 and Appendix E of MASH. | No occupant compartment deformation or intrusion occurred. | |
| G. | It is preferable, although not essential, that the vehicle remain upright during and after collision. | The 10000S vehicle remained upright during and after the collision event. Maximum roll and pitch angles were 16° and 6°, respectively. | Pass |

Tables 2-4 indicate that the barrier 3 shown in the Figures passed each of the MASH TL-4 evaluation criteria. This is a significant endorsement of the barrier 3.

Many modifications may be made to the preferred embodiment of the invention described above without departing from the spirit and scope of the invention.

Whilst the above described embodiment of the barrier 3 is constructed from steel, it can readily be appreciated that the present invention is not so limited and extends to barriers made from any suitable materials. By way of example, the outer shell could be made from aluminum or suitable plastic materials.

In addition, whilst the side walls 7 of the above described embodiment are straight walls that converge towards each other from the base wall 5, it can readily be appreciated that the present invention is not so limited and extends to profiled side walls, such as side walls that have elongate ribs formed in the side walls.

In addition, the invention extends to embodiments in which the side walls 7 to not converge towards each other from the base wall 5 and extend upwardly perpendicular to the base wall 5.

In addition, whilst the above described embodiment of the barrier 3 is described as typically being 5.8 m long, 900 mm high, 450 mm wide at the base and 200 mm wide at the top, it can readily be appreciated that the present invention is not so limited and extends to barriers 3 of any suitable dimensions.

In addition, whilst the above described embodiment of the barrier 3 is described as having an outer shell and an upper structural element 13 of the barrier 3 that are formed as separate components of the barrier 3 and are connected together to form the barrier, it can readily be appreciated that the present invention is not so limited and extends to barriers 3 that are formed in any other suitable way, noting that the key requirement of the invention is to provide a structure, such as an outer shell, that defines a cavity and is formed so that a settable ballast material can be poured into the cavity and contained by the structure, with the ballast material ultimately setting to form a solid block of ballast material.

Further to the preceding paragraph, the invention is not confined to the use of an outer shell and extends to any suitable structure that defines a cavity and is formed so that a settable ballast material can be poured into the cavity and contained by the structure, with the ballast material ultimately setting to form a solid block of ballast material.

In addition, whilst the above described embodiment of the barrier 3 is described as having the base wall 5 and the side walls 7 of the outer shell formed from two separate mirror-image components and the end walls 9 of the outer shell are also formed as separate components, it can readily be appreciated that the present invention is not so limited and extends to barriers 3 that are formed in any other suitable way. For example, the outer shell could be formed as a one-piece unit. By way of further example, the outer shell could be formed from more than two components.

In addition, whilst the above described embodiment of the barrier 3 is described as having the openings 23 in the end walls 9 of the outer shell of the barrier 3, it can readily be appreciated that the present invention is not so limited and extends to barriers 3 with openings in other parts of the barrier, such as the top of the barrier 3.

What is claimed is:

1. A transportable elongate vehicle impact barrier that comprises:

(a) an outer shell in an elongate lower section of the barrier that defines a cavity, the outer shell comprising a base wall, opposed side walls and opposed end walls that define the cavity;

(b) an upper structural element extending along the length of the barrier and connected to the outer shell, the upper structural element comprising any one of a hollow beam, a hollow box beam, and a solid beam;

(c) a solid block of a ballast material in the cavity formed from a pourable settable ballast material; and (d) complementary connectors affixed to the opposed end walls of the barrier to allow a plurality of the barrier to be connected together in end-to-end relationship;

wherein the upper structural element and the ballast material provide the barrier with sufficient rigidity for resisting collapse of the barrier in response to vehicle impact.

2. The barrier defined in claim 1 comprises a single cavity that extends at least substantially the length of the barrier.

3. The barrier defined in claim 1 comprises a plurality of cavities spaced apart along the length of the barrier and the barrier comprises at least two solid blocks of the ballast material in the cavities along the length of the barrier.

4. The barrier defined in claim 1 wherein one or both end walls are formed with an opening to allow the pourable settable ballast material to be poured into the cavity during manufacture of the barrier.

5. The barrier defined in claim 1 wherein the base wall and the side walls of the outer shell comprise two components that are connected together, with each component being formed by folding two sheets of steel strip/plate along the length of each sheet to form one side wall and one-half section of the base wall.

6. The barrier defined in claim 5 wherein the end walls of the outer shell comprise separate components connected to the base wall and side walls of the outer shell.

7. The barrier defined in claim 1 wherein the hollow box beam section comprises a sheet of steel strip/plate folded along the length of the sheet to form the box beam section.

8. The barrier defined in claim 1 wherein the ballast material is concrete having a compressive strength of at least 20 MPa.

9. The barrier defined in claim 1 wherein the height of the ballast block is lower than the height of the typical vehicle impact with the barrier and less than 50% of the total height of the barrier.

10. The barrier defined in claim 1 wherein the weight of the ballast block is up to 85% of the total weight of the barrier.

11. The barrier defined in claim 1 wherein the weight of the barrier is less than 450 kg/m of length of the barrier.

12. The barrier defined in claim 1 comprises one or more than one lifting point for the barrier.

13. The barrier defined in claim 1 wherein the upper structural element provides longitudinal strength that can restrain and contain and re-direct a vehicle while resisting substantial bending of the element during use of the barrier.

14. The barrier defined in claim 1 wherein the outer shell comprises folded sheets of steel strip/plate.

15. The barrier defined in claim 1 wherein the outer shell comprises at least one opening to allow pourable settable ballast material to be poured into the cavity during manufacture of the barrier.

16. A transportable barrier assembly comprising a plurality of elongate barriers connected together in end-to-end relationship in a line of the barriers, each barrier comprising:

(a) an outer shell in an elongate lower section of the barrier that defines a cavity, the outer shell comprising a base wall, opposed side walls and opposed end walls that define the cavity, and the outer shell having at least one opening to allow pourable settable ballast material to be poured into the cavity during manufacture of the barrier;

(b) a solid block of a pourable settable ballast material in the cavity;

(c) an upper structural element extending along the length of the barrier and connected to the outer shell, the upper structural element comprising any one of a hollow beam, a hollow box beam, and a solid beam; and (d) complementary connectors affixed to the opposed end walls of the barrier and connect together the plurality of the barriers in end-to-end relationship.

17. A method of manufacturing a transportable elongate barrier, the transportable elongate vehicle impact barrier comprising:

(a) an outer shell in an elongate lower section of the barrier that defines a cavity, the outer shell comprising a base wall, opposed side walls and opposed end walls that define the cavity;

(b) an upper structural element extending along the length of the barrier and connected to the outer shell, the upper structural element comprising any one of a hollow beam, a hollow box beam, and a solid beam;

(c) a solid block of a ballast material in the cavity formed from a pourable settable ballast material; and (d) complementary connectors affixed to the opposed end walls of the barrier to allow a plurality of the barrier to be connected together in end-to-end relationship;

wherein the upper structural element and the solid block of the ballast material provide the barrier with sufficient rigidity for resisting collapse of the barrier in response to vehicle impact;

the method compromising:

(i) forming the outer shell with at least one opening to allow a pourable settable ballast material to be poured into the cavity, (ii) forming the upper structural element, (iii) connecting together the outer shell and the upper structural element, and (iv) pouring the pourable settable ballast material into the cavity and allowing the ballast material to set and form the solid block of the ballast material in the cavity.

18. The method defined in claim 17 wherein the upper structural element comprises a hollow box beam section, and the method comprises forming the hollow box beam section structural element by folding a sheet of steel strip/plate along the length of the sheet to form the hollow box beam section.

* * * * *